US006112374A

United States Patent [19]

Van Erden

[11] Patent Number: 6,112,374

[45] Date of Patent: Sep. 5, 2000

[54] ZIPPER FOR SLIDER PACKAGE

[75] Inventor: Donald Van Erden, Wildwood, Ill.

[73] Assignee: Illinois Tool Works Inc., Glenview, Ill.

[21] Appl. No.: 09/128,858

[22] Filed: Aug. 4, 1998

Related U.S. Application Data

[63] Continuation-in-part of application No. 09/093,111, Jun. 8, 1998.

[51] Int. Cl.[7] ..... A44B 19/40; B65D 33/00; B65D 77/00

[52] U.S. Cl. ..... 24/400; 24/389; 24/399; 24/587

[58] Field of Search ..... 24/400, 389, 399, 24/587, 30.5 R

[56] References Cited

U.S. PATENT DOCUMENTS

| | | | |
|---|---|---|---|
| 3,806,998 | 4/1974 | Laguerre | 24/400 |
| 4,791,710 | 12/1988 | Nocek et al. | 24/400 |
| 4,878,763 | 11/1989 | Ausnit | 24/587 |
| 4,947,525 | 8/1990 | Van Erden | 24/587 |
| 5,007,143 | 4/1991 | Herrington | 24/400 |
| 5,020,194 | 6/1991 | Herrington et al. | 24/389 |
| 5,131,121 | 7/1992 | Herrington, Jr. et al. | 24/436 |
| 5,655,273 | 8/1997 | Tomic et al. | 24/587 |
| 5,664,299 | 9/1997 | Porchia et al. | 24/400 |
| 5,672,009 | 9/1997 | Malin | 24/587 |
| 5,718,024 | 2/1998 | Robbins | 24/30.5 R |

*Primary Examiner*—Victor N. Sakran
*Attorney, Agent, or Firm*—Pitney, Hardin, Kipp and Szuch LLP

[57] ABSTRACT

A slide zipper assembly comprising an interlocking zipper and a slider is provided. The zipper has a first profile and a second profile. The profiles each have a ribbon, a web attached to the ribbon, and an interlocking member attached to the web engageable with the interlocking member of the other profile. The slider is disposed for movement along the zipper and has a top from which two arms depend. The slider arms enclose the profile ribbons and have hooked ends which each hook around a profile ribbon to become positioned between the ribbon and its corresponding web.

14 Claims, 4 Drawing Sheets

ZIPPER FOR SLIDER PACKAGE

CROSS REFERENCE TO RELATED APPLICATIONS

This application is a continuation-in-part (CIP) of Ser. No. 09/093,111, filed Jun. 8, 1998, the disclosure of which is incorporated herein by reference.

BACKGROUND OF THE INVENTION

The present invention relates to reclosable plastic bags of the type in which items may be stored. More particularly, the present invention relates to a slide zipper for use with such plastic bags and a method for making the zipper.

Description of the Prior Art

Slide zippers have different requirements than traditional interlocking zippers which are opened and closed directly by the hands of the user. First, the manufacturing tolerances are much smaller. Second, the slider must smoothly interact with the zipper to open and close the bag. Third, the zipper must interact with the slider to resist having the slider pulled off the zipper from the top of the bag. And fourth, the zipper must interact with the slider to resist having the slider pulled off the end of the zipper from the side of the bag.

Slide zippers for use with plastic bags are well known in the reclosable fastener art. Examples of conventional slide zippers can be found in U.S. Pat. Nos. 5,007,143, 5,008,971, 5,131,121 and 5,664,299. However, many prior art slide zippers have proven problematic in that they do not adequately satisfy the aforementioned requirements.

Recently, a new type of slider zipper has been developed which, as disclosed in the parent of the present application, improves on prior art slide zippers and satisfies the aforementioned requirements.

The present invention relates to a slide zipper which further improves on prior art slide zippers and which satisfies all of the aforementioned requirements.

SUMMARY OF THE INVENTION

The present invention is a novel and unique slide zipper and a method for making the zipper. The zipper is comprised of two interlocking profiles, each profile including an interlocking member for interlocking with the interlocking member of the other profile, a web for sealing each profile to a plastic bag, and a ribbon for interacting with the slider.

In a preferred embodiment the interlocking members each have a pair of hooked arms. The hooks on the first interlocking member are oriented outwardly with respect to each other and are adapted to engage the hooks of the second interlocking member, which are oriented inwardly with respect to each other.

The slider straddles the zipper, interacting with the profile ribbons, and is slidable therealong. As oriented on a bag having the zipper at the top, the slider consists of a top from which two arms depend. The slider bottom is defined by two inwardly directed hooked ends, each hooked end hooking around a profile ribbon so that it becomes positioned between the ribbon and its corresponding web, thereby holding the slider in place and preventing the slider from being pulled off the zipper. In addition, to keep the slider from coming off the ends of the zipper the profiles are sealed together at either end so that when the slider reaches the ends of the zipper the hooked ends of the slider arms will contact the sealed area and be prevented from moving any further.

The slider has an opening end and a closing end. At the closing end the slider arm inner walls are sufficiently close to one another to press the two profiles into engagement when the slider is moved in the closing direction (i.e. opposite to the closing end). At the opening end of the slider there is a contoured separator blade which extends downwardly from the top of the slider and which is engageable with the top hooked arm of the first interlocking member.

When the slider is moved in the opening direction, the separator blade disengages the top hooked arms of the interlocking members and a force component on the top hooked arm of the first interlocking member urges the top of the first profile away from the second profile. At the opening end of the slider the inner walls of the slider arms are further apart than at the closing end such that the slider arms do not force the profiles into engagement. The opening end of the slider may also be provided with a cavity or recess to facilitate lateral movement of the first profile.

Additionally, the hooked end on the first slider arm engages the bottom of the ribbon portion of the first profile and lifts the same so that the bottom hooked arms of the two interlocking members also disengage. The combined actions of the separator blade and the hooked end on the first slider arm thus serve to first disengage the top hooked arm of the first interlocking member from the top hooked arm of the second interlocking member, then move the first profile away from the second profile, and then lift the bottom hooked arm of the first interlocking member out of engagement with the bottom hooked arm of the second interlocking member to thereby free the first profile from the second profile. Alternatively, the second slider arm could force the second profile downwardly out of engagement with the first profile.

The present invention will now be described in more complete detail with reference being made to the figures identified below wherein the same numerals represent identical elements.

DETAILED DESCRIPTION OF THE PREFERRED EMBODIMENT

Figure 1:
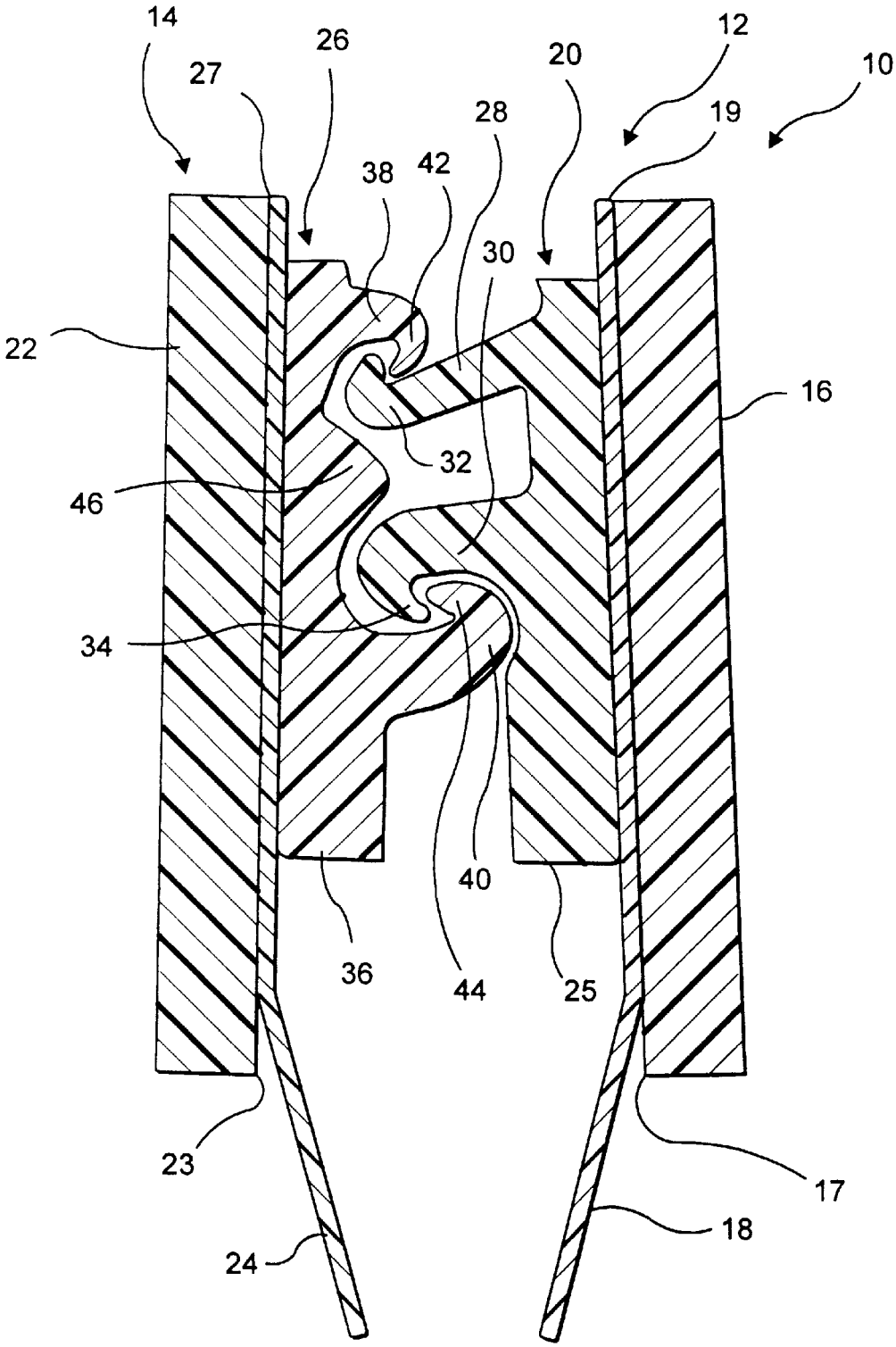
FIG. 1 is a cross sectional view of an interlockable zipper in accordance with the present invention.
Figure 5:
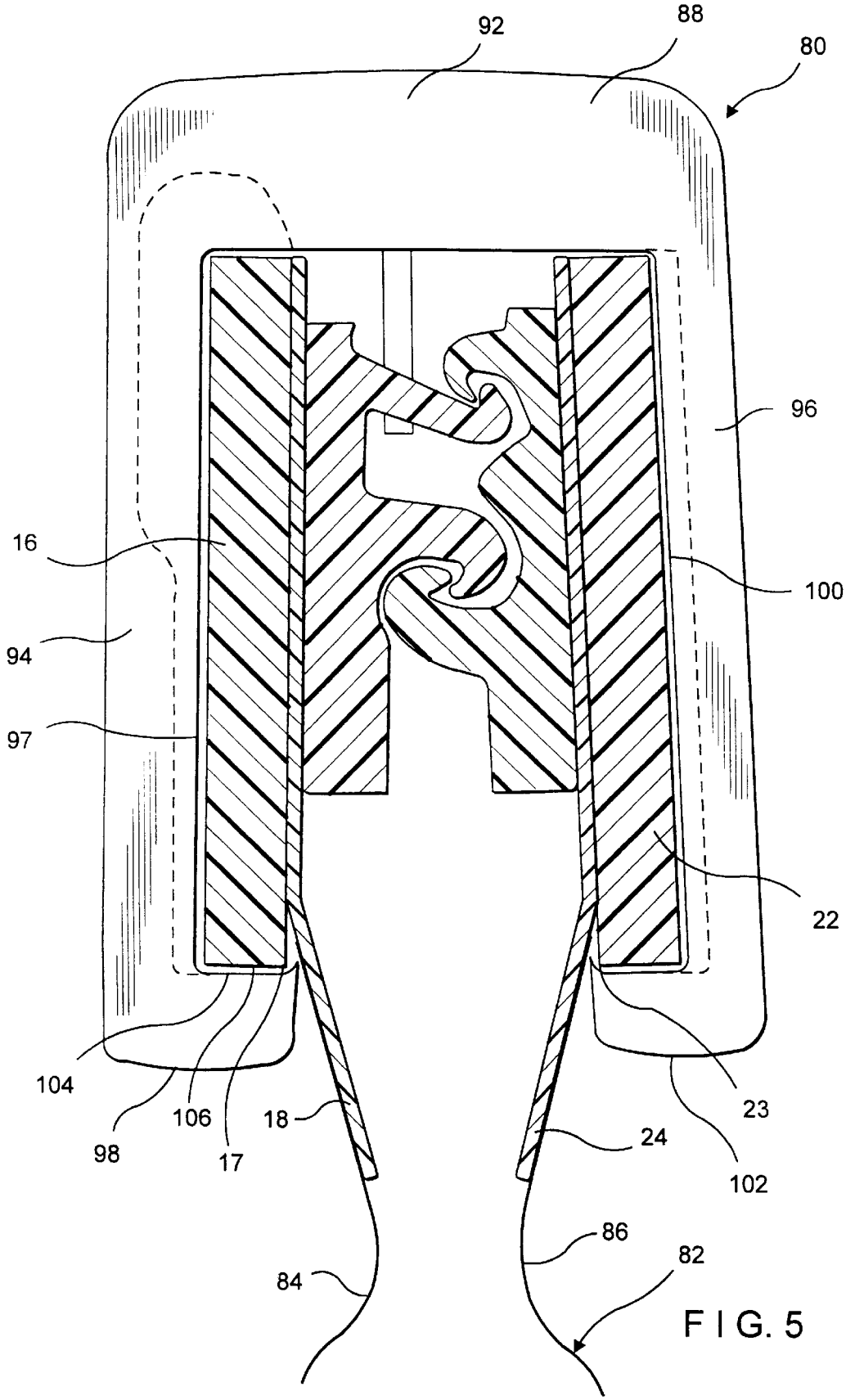
FIG. 5 is a cross sectional view of the closing end of a slide zipper in accordance with the present invention attached to a plastic bag.
Figure 6:
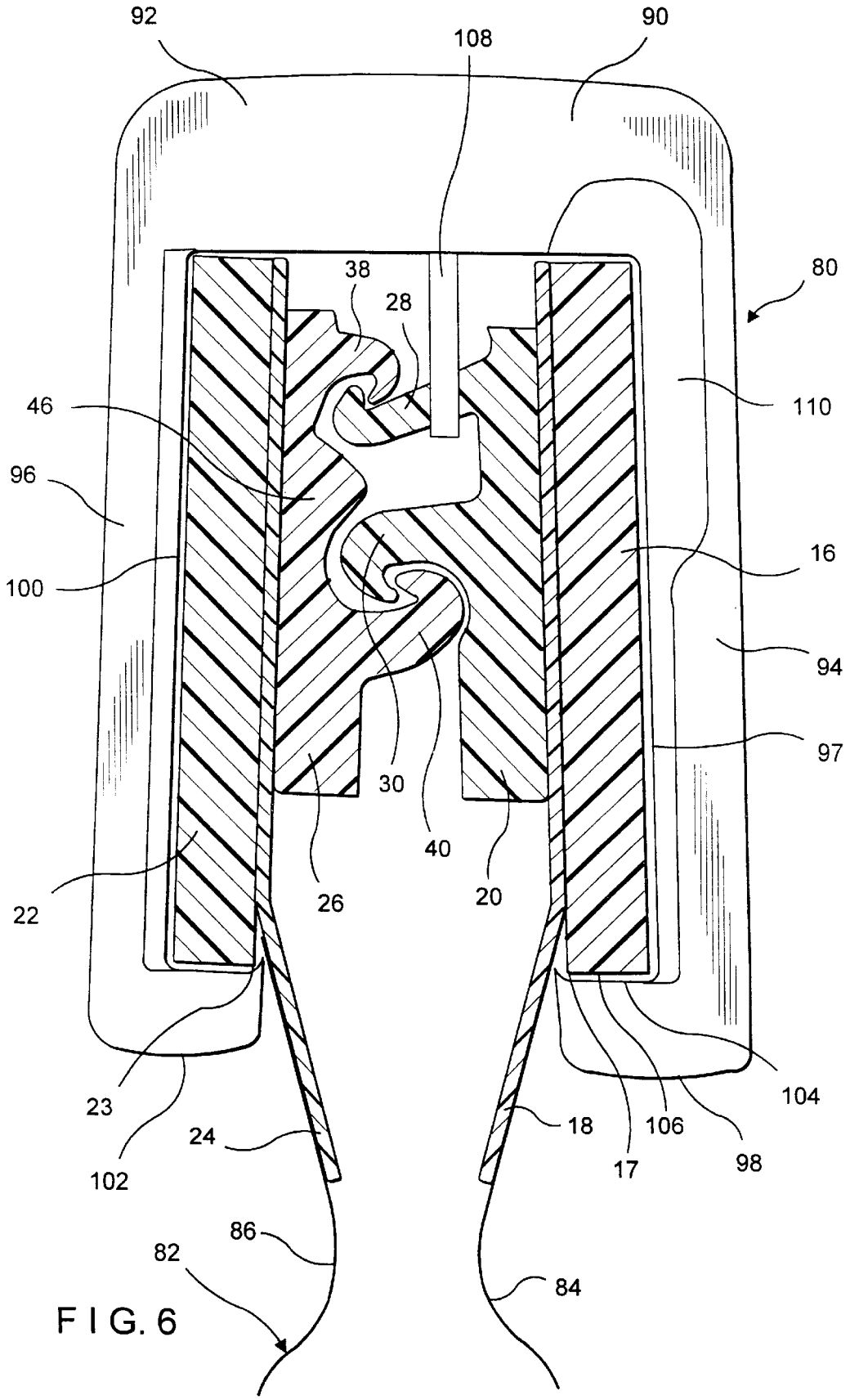
FIG. 6 is a cross sectional view of the opening end of a slide zipper in accordance with the present invention attached to a plastic bag.

FIG. 1 shows a cross sectional view of a zipper 10 in accordance with the present invention. The zipper 10 is comprised of a first profile 12 and a second profile 14. The zipper 10 is disposable along the opening of a plastic bag 82, as shown in FIGS. 5 and 6. For purposes of this description, the bag 82 will be assumed to be oriented with its opening on top, as depicted in FIGS. 5 and 6.

The first profile 12 includes a ribbon 16, a web 18 attached to the ribbon 16, and an interlocking member 20 attached to the web 18. The ribbon 16 has a free end 17 which is not attached to the web 18 and an end 19 which is attached to the web. Similarly, the second profile 14 includes a ribbon 22, a web 24 attached to the ribbon 22, and an interlocking member 26 attached to the web 24 which mates with the interlocking member 20 of the first profile 12. The ribbon 22 has a free end 23 which is not attached to the web 24 and an end 27 which is attached to the web. The interlocking members, ribbons and webs of each profile are separately extruded from a plastic commonly used in the reclosable packaging industry, such as polyethylene, and then fused together to form the integrated zipper 10. As discussed more fully below, the profile webs 18, 24 provide a means by which the zipper may be sealed to a plastic bag and also provide a means by which the zipper may be guided in an automated bag making process, such as on a form-fill-seal machine. The profile ribbons interact with the slider to hold the slider on the zipper and provide a path along which the slider may slide.

The first interlocking member 20 has a base 25 and top and bottom hooked arms 28, 30 extending from the base 25 toward the second profile 14. The top hooked arm 28 and the bottom hooked arm 30 of the first interlocking member 20 have hooked ends 32 and 34 which are directed away from each other. Thus, the hooked end 32 of the top hooked arm 28 is oriented upwardly while the hooked end 34 of the bottom hooked arm 30 is oriented downwardly. As is clear from FIG. 1, the top hooked arm 28 is longer and thinner than the bottom hooked arm 30. The top hooked arm 28 is thus more flexible than the bottom hooked arm 30, thereby providing for ease of opening of the zipper 10 from the outside of a bag employing the zipper 10. Conversely, because the bottom hooked arm 30 is shorter and thicker than top hooked arm 28, and thus less flexible, the internal opening force will be greater.

The second interlocking member 26 likewise has a base 36 and top and bottom hooked arms 38, 40. The top hooked arm 38 and bottom hooked arm 40 have hooked ends 42, 44 which are directed towards each other and positioned and sized to engage the hooked ends 32, 34 of the first profile hooked arms. Thus, the top hooked arm 38 has a downwardly oriented hooked end 42 which is engageable with the hooked end 32 of the top hooked arm 28 of the first interlocking member 20 and the bottom hooked arm 40 has an upwardly oriented hooked end 44 which is engageable with the hooked end 34 of the bottom hooked arm 30 of the first interlocking member 20. This twoarm configuration of the zipper 10 provides a relatively leak proof seal. The second interlocking member 26 may also have an inwardly directed wedge or bump 46 which is located between the top hooked arm 38 and the bottom hooked arm 40 and which aids in guiding the interlocking members into and out of engagement.

Figure 2:
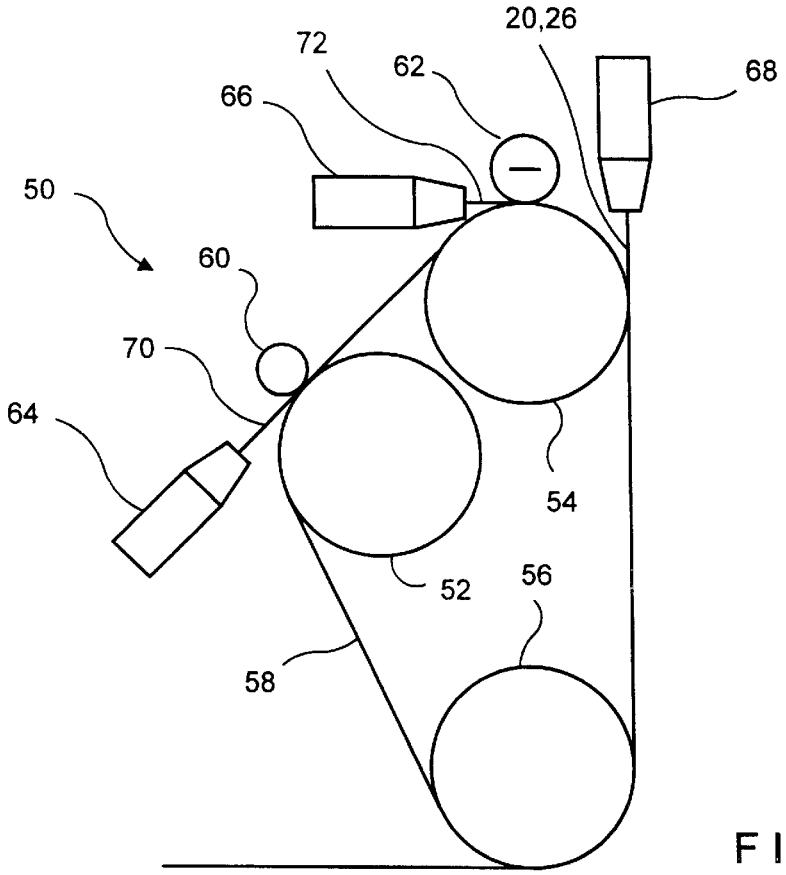
FIG. 2 is a diagram of a first type of apparatus used to manufacture the zipper of FIG. 1.

As discussed above, the various zipper components are separately extruded and then fused together to form the final integral zipper 10. A first apparatus 50 for manufacturing the zipper is shown in FIG. 2.

The first apparatus 50 comprises three rolls 52, 54, 56 driven by a belt 58, two pinch rolls 60, 62, and three extruders 64, 66, 68. In operation the first extruder 64 extrudes a ribbon of material 70, such as polyethylene, into a groove on the belt 58. The first pinch roll 60 fits into the belt groove and ensures that the ribbon 70 is extruded into the groove. While no specific dimension for the ribbon 70 is required, dimensions of approximately 0.020" thick by 0.375" wide is preferred.

The second extruder 66 extrudes a web of material 72, such as polyethylene, having preferred dimensions of approximately 0.002" thick by 1.375" wide, on top of the second roll 54 and the ribbon 70. As discussed above, the ribbon 70 is recessed in the belt groove, and the second pinch roll 62 deflects the web 72 into the groove and onto the center of the ribbon 70, causing the ribbon 70 and the web to become fused together. The width of the second pinch roll 62 is less than the width of the ribbon 70 such that the ribbon 70 does not become fused to the web 72 at its edges.

Figure 3:
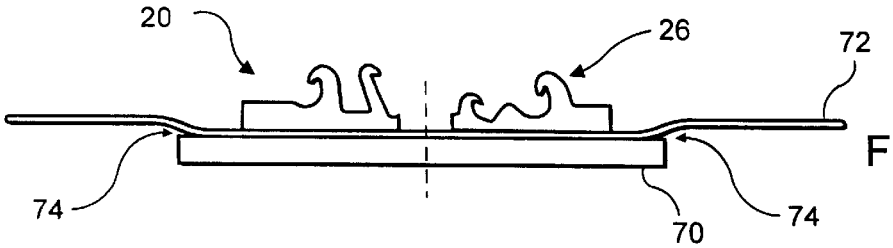
FIG. 3 is a cross sectional view of the zipper after manufacture.

The third extruder 68 then extrudes the interlocking members 20, 26 in an uninterlocked condition onto the portion of the web 72 which was fused to the ribbon 70. The result of this process is shown in FIG. 3. The ribbon 70 is centrally fused to the web 72, and the interlocking member 20, 26 are fused to the portion of the web 72 which is fused to the ribbon 70. The ribbon 70 is not fused to the web 72 at its edges 74. This will aid in keeping the slider on the zipper, as discussed more fully below. In order to complete the zipper 10, the ribbon 70 and web 72 are slit along the centerline to form the two separate profiles 12, 14, which may then be interlocked as shown in FIG. 1.

Figure 4:
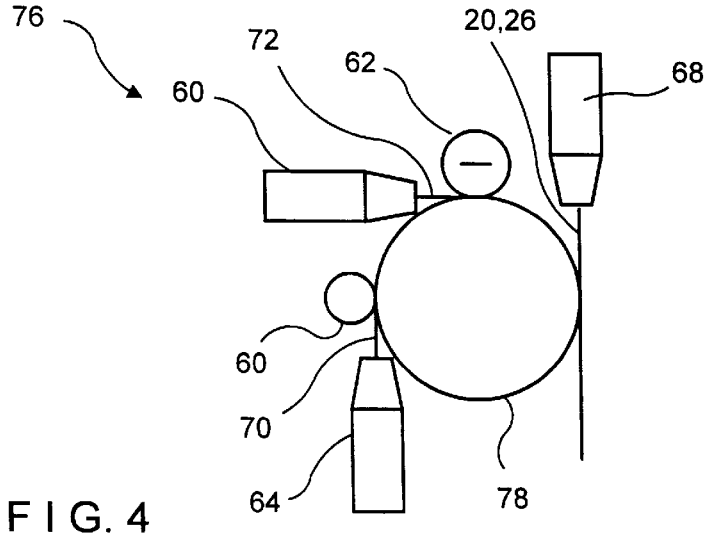
FIG. 4 is a diagram of a second type of apparatus used to manufacture the zipper of FIG. 1.

A second apparatus 76 for manufacturing the zipper is shown in FIG. 4. The second apparatus 76 differs from the first apparatus 50 in that a single roll 78 is used, instead of a belt in combination with three rolls. The ribbon 70 is extruded into a groove in the roll 78. This is facilitated by pinch roll 60. The web 72 is then extruded onto the roll 76 and the ribbon 70, the second pinch roll 62 fusing the two together. Finally, the interlocking members 20, 26 are extruded onto the web portion 72 fused to the ribbon 70, resulting in the zipper of FIG. 3. The zipper is then slit to arrive at the zipper of FIG. 1.

Returning to the discussion of how the slide zipper of the present invention functions, FIGS. 5 and 6 illustrate how the zipper 10 cooperates with a slider 80. The zipper 10 is attached to a plastic bag 82 by sealing the zipper webs 18, 24 to opposing bag walls 84, 86. The slider 80 straddles the zipper 10 enclosing the profile ribbons 16, 22. The slider 80 has a closing end 88 and an opening end 90. The slider closing end is shown in FIG. 5 and the slider opening end is shown in FIG. 6. When the slider is moved in the direction opposite to its closing end, the interlocking members 20, 26 are engaged by the slider. When the slider is moved in the direction opposite to its opening end, the interlocking members are disengaged by the slider. The profiles are sealed to each other at both ends to ensure that the slider cannot be pulled off the zipper in a sidewardly direction.

The slider 80 has a top portion 92, a first arm 94 and a second arm 96. Enough clearance is provided between the slider top 92 and the zipper so that the slider can be inserted over the zipper and seated thereupon as shown in FIGS. 5 and 6. The first arm 94 has an inner side 97 and an inwardly directed hooked end 98. Likewise, the second arm 96 has an inner side 100 and an inwardly directed hooked end 102. The inner sides 97, 100 of the slider arms are tapered from the opening end 90 towards the closing end 88 so that at the closing end 88 the arms are sufficiently close to press the profiles into engagement with each other. The hooked ends 98, 102 of the slider arms hook around the free ends 17, 23 profile ribbons 16, 22 such that they become positioned between the ribbons 16, 22 and webs 18, 24. In this manner the slider 80 is held in place on the zipper 10 and cannot be pulled off the zipper 10 without destroying the zipper 10. It is for this reason that during the zipper manufacturing process the ribbon edges 74 are not sealed to the web 72. A top surface 104 of first slider arm hooked end 98 mates with a bottom surface 106 of the first profile ribbon 16, imparting a generally upward force thereto. This force, as discussed below, plays a role in the opening and closing action of the slider 80.

As is clear from FIG. 5, the zipper 10 is captured between the inner sides 97, 100 of the slider arms 94, 96. The slider arm hooked ends 98, 102 hold the slider in place and ensure that it cannot be pulled off the zipper. The inner sides 97, 100 of the slider arms 94, 96 are sufficiently close at the closing end so that when the slider 80 is moved in the closing direction, the inner sides 97, 100 of the slider arms 94, 96 press against the profile ribbons 16, 22, thereby effecting engagement of the profiles 12, 14.

FIG. 6 shows the opening end 90 of the slider 80. At the opening end 90 the inner sides 97, 100 of the slider arms 94, 96 are sufficiently far apart so as to not impart a closing force to the profiles 12, 14 and to allow for disengagement of the profiles 12, 14. To this end, at the opening end 90 a separator blade 108 extends downwardly from the slider top 92 as shown. In addition, the inner side 97 of first slider arm 94 is contoured to define a cavity 110 which extends upwardly into the top 92. The separator blade 108 is positioned so that when the slider 80 is moved in the opening direction, the separator blade 108 will deflect the top hooked arm 28 of the first interlocking member 20 downwardly and out of engagement with the top hooked arm 38 of the second interlocking member 26. A component of the force on the top hooked arm 28 of the first interlocking member 20 will also direct the now disengaged first profile 12 sideways and into the cavity 110.

The separator blade 108 deflects the top hooked arm 28 of the first interlocking member 20 downwardly and out of engagement with the top hooked arm 38 of the second interlocking member 26 until the top hooked arm 28 engages the bump 46. The bump 46 provides a camming surface for the top hooked arm 28 as a component of the force exerted by the separator blade 108 acts on the top hooked arm 28 to urge the first profile 12 away from the second profile 14. Simultaneously, the top surface 104 of the first slider arm hooked end 98 pushes the first ribbon bottom surface 106 upwardly. This upward deflection in combination with the outward deflection of the first profile 12 by the separator blade 108 disengages the bottom hooked arm 30 of the first interlocking member 20 from the bottom hooked arm 40 of the second interlocking member 26 and moves the first profile 12 up and into the cavity 110. Alternatively, means could be provided to force the second profile downwardly out of engagement with the first profile, as opposed to forcing the first profile upwardly.

Thus, the combined action of the separator blade 108 and first slider arm hooked end 98 on the first profile serves to open the zipper as the slider is moved in the opening direction. Movement of the slider in the closing direction causes the slider arms to force the profiles into engagement.

Modifications to the above would be obvious to those of ordinary skill in the art, but would not bring the invention so modified beyond the scope of the appended claims.

What is claimed is:

1. A slide zipper assembly comprising:

an interlocking zipper having a first profile and a second profile;

said first profile including a ribbon, a web attached to said ribbon, and an interlocking member attached to said web, said ribbon having a free end unattached to said web;

said second profile including a ribbon, a web attached to said ribbon, and an interlocking member attached to said web engageable with said first profile interlocking member, said ribbon having a free end unattached to said web;

a slider disposed for movement along said zipper, said slider including a top and first and second arms depending from said top, each of said arms having a hooked end directed towards the other arm;

wherein said slider is positionable on said zipper so that said first and second slider arms enclose said first and second profile ribbons, respectively, and so that said first and second slider arm hooked ends hook around said first and second profile ribbon free ends, respectively, so that each of said hooked ends becomes positioned between a ribbon and its attached web.

2. A slide zipper assembly according to claim 1 wherein said ribbon free ends are opposite to said slider top.

3. A slide zipper assembly according to claim 1 wherein said ribbons have ends opposite to said free ends which are attached to said webs.

4. A slide zipper assembly according to claim 1:

wherein said first profile interlocking member includes a base having a top arm and a bottom arm extending from said base, each of said arms having a hooked end directed away from the other arm;

wherein said second profile interlocking member includes a base having a top arm and a bottom arm extending from said base, each of said second profile interlocking member arms having a hooked end directed toward the other arm; and wherein said first profile interlocking member arms position between said second profile interlocking member arms with the hooked ends of said first and second profile interlocking member arms engaged when said zipper is in a closed position.

5. A slide zipper assembly according to claim 4 wherein said slider further includes a separator extending downwardly from said slider top, said separator being disposed to engage said first profile interlocking member top arm to bend the same toward said first profile interlocking member bottom arm, whereby to disengage the hooked end of said first profile interlocking member top arm from the hooked end of said second profile interlocking member top arm.

6. A slide zipper assembly according to claim 5 wherein said separator is disposed to urge said first profile away from said second profile.

7. A slide zipper assembly according to claim 6 wherein said second profile interlocking member further includes a member extending from said base between said top and bottom arms, said member having a top camming surface disposed to receive said first profile interlocking member top arm bent by said separator to urge said first profile away from said second profile.

8. A slide zipper assembly according to claim 7 wherein a top surface of said first slider arm hooked end is disposed to engage a bottom surface of said first profile ribbon and lift the hooked end of said first profile interlocking member bottom arm out of engagement with the hooked end of said second profile interlocking member bottom arm.

9. A slide zipper assembly according to claim 4 wherein said first profile top arm is longer and thinner than said first profile bottom arm.

10. A slide zipper assembly according to claim 1:

wherein said slider has an opening end and a closing end;

wherein at said closing end said slider arms are sufficiently close together to press said profiles into engagement when said slider is moved in a closing direction; and wherein at said opening end said slider arms are sufficiently far apart so as not to press said profiles into engagement when said slider is moved in an opening direction.

11. A slide zipper assembly according to claim 10 wherein said separator is located at said opening end.

12. A slide zipper assembly according to claim 10 wherein said opening end includes a cavity for receiving said first profile after it is disengaged from said second profile.

13. A slide zipper assembly comprising:

an interlocking zipper having a first profile and a second profile;

said first profile including a ribbon, a web attached to said ribbon and an interlocking member attached to said web, said second profile including a ribbon, a web attached to said ribbon and an interlocking member attached to said web and engageable with said first profile interlocking member, and a slider disposed for movement along said zipper, said slider including a top and first and second arms depending from said top, each of said first and second arms including a bottom end hooked respectively about bottom ends of said first and second profile ribbons, wherein each of said first and second profile webs is free of attachment to its respective ribbon for a distance extending upwardly from said ribbon bottom ends.

14. A slide zipper assembly in accordance with claim 13 wherein said ribbon, web and interlocking member of said first and second profiles are separately extruded and fused together.

* * * * *